US007462407B2

(12) United States Patent
Maeda et al.

(10) Patent No.: US 7,462,407 B2
(45) Date of Patent: Dec. 9, 2008

(54) FLUORIDE-CONTAINING COATING AND COATED MEMBER

(75) Inventors: Takao Maeda, Takefu (JP); Hajime Nakano, Takefu (JP); Satoshi Shima, Takefu (JP)

(73) Assignee: Shin-Etsu Chemical Co., Ltd., Tokyo (JP)

( * ) Notice: Subject to any disclaimer, the term of this patent is extended or adjusted under 35 U.S.C. 154(b) by 33 days.

(21) Appl. No.: 10/737,875

(22) Filed: Dec. 18, 2003

(65) Prior Publication Data

US 2004/0126614 A1 Jul. 1, 2004

(30) Foreign Application Priority Data

Dec. 19, 2002 (JP) ..... 2002-368426

(51) Int. Cl.
*B32B 9/00* (2006.01)

(52) U.S. Cl. ..... 428/696; 428/432; 428/469; 428/701; 428/702; 428/698; 428/457

(58) Field of Classification Search ..... None
See application file for complete search history.

(56) References Cited

U.S. PATENT DOCUMENTS

| | | | | |
|---|---|---|---|---|
| 5,282,084 | A * | 1/1994 | Hatano | 359/360 |
| 5,798,016 | A | 8/1998 | Oehrlein et al. | |
| 6,254,935 | B1 | 7/2001 | Eaton et al. | |
| 2002/0015853 | A1 * | 2/2002 | Wataya et al. | 428/469 |

FOREIGN PATENT DOCUMENTS

| | | | |
|---|---|---|---|
| JP | 11-145526 | A | 5/1999 |
| JP | 11-314999 | A | 11/1999 |
| JP | 3017528 | B2 | 12/1999 |
| JP | 2000-345315 | A | 12/2000 |
| JP | 2001-97791 | A | 4/2001 |
| JP | 2001-164354 | A | 6/2001 |
| JP | 3243740 | B2 | 10/2001 |

(Continued)

OTHER PUBLICATIONS

"Periodic Table of Elements," CRC Handbook of Chemistry and Physics, 68th Edition, CRC Press, Boca Raton, FL, 1987-1988.*

(Continued)

*Primary Examiner*—Timothy M Speer
(74) *Attorney, Agent, or Firm*—Birch, Stewart, Kolasch & Birch, LLP

(57) ABSTRACT

A Group IIIA element fluoride-containing coating comprising a Group IIIA element fluoride phase which contains at least 50% of a crystalline phase of the orthorhombic system belonging to space group Pnma is formed on a member for imparting corrosion resistance so that the member may be used in a corrosive halogen species-containing atmosphere. When the state of a crystalline phase is properly controlled, the coating experiences only a little color change by corrosion. A Group IIIA element fluoride-containing coating having a micro-Vickers hardness Hv of at least 100 is minimized in weight loss by-corrosion.

20 Claims, 3 Drawing Sheets

FOREIGN PATENT DOCUMENTS

| | | | |
|---|---|---|---|
| JP | 3261044 | B2 | 12/2001 |
| JP | 2002-115040 | A | 4/2002 |
| JP | 2002-222803 | A | 8/2002 |
| JP | 2002-249864 | A | 9/2002 |
| JP | 2002-252209 | A | 9/2002 |
| JP | 2002-293630 | A | 10/2002 |

OTHER PUBLICATIONS

Valerio, et al., "Derivation of potentials for the rare-earth fluorides, and the calculation of lattice and intrinsic defect properties," J. Phys.: Condens. Matter, 12 (2000), 7727-7734.*

O. Greis et al., Themochimica Acta, 87, "Polymorphism of High-Purity Rare Earth Trifluorides" pp. 145-150 (1985).*

* cited by examiner

FLUORIDE-CONTAINING COATING AND COATED MEMBER

This Nonprovisional application claims priority under 35 U.S.C. § 119(a) on patent application Ser. No(s). 2002-368426 filed in JAPAN on Dec. 19, 2002, the entire contents of which are hereby incorporated by reference.

BACKGROUND OF THE INVENTION

1. Field of the Invention

This invention relates to Group IIIA element fluoride-containing coatings for use in improving the corrosion resistance of members to be exposed to a corrosive halogen species-containing atmosphere, and coated members having such coatings.

2. Background Art

The applications where corrosive halogen species are present include plasma-assisted processes (e.g., plasma etching and plasma CVD) for semiconductor manufacture, incinerators and the like. In the semiconductor process, objects are etched, cleaned or otherwise treated utilizing the activity of corrosive halogen species. At the same time, members used in the atmosphere where such active halogen species are present are also affected thereby, undergoing corrosion. To minimize such impacts, highly corrosion resistant materials are under study. The members used in the corrosive atmosphere include ceramic materials such as sintered alumina, sintered magnesia, sintered aluminum nitride, and sintered yttrium aluminum double oxide, graphite, quartz, silicon, metal materials such as aluminum alloys, anodized aluminum alloys, stainless alloys, and nickel alloys, and non-metallic materials such as polyimide resins.

Metal base materials are often used at sites where electroconductivity is necessary and as housings because large size members thereof can be easily worked. Quartz, silicon and graphite members cause less contamination to the silicon semiconductor process because of high purity and are thus used in wafer surroundings within the processing container. Ceramic materials have electric insulation and relatively high durability to corrosive halide gases as compared with other materials and are thus used at sites where electric insulation or durability to corrosive halide gases is necessary.

It has also been studied to react ceramic materials such as alumina, magnesia, aluminum nitride, and yttrium aluminate with elemental fluorine to convert only the surface to a fluoride.

JP-A 2002-252209 discloses a method for further improving the corrosion resistance of a member by forming a thermally sprayed coating or sintered layer of yttrium fluoride instead of yttrium oxide on the member for thereby preventing the chemical change from yttrium oxide to yttrium fluoride.

Reference is made to Japanese Patent No. 3,017,528, Japanese Patent No. 3,243,740 (U.S. Pat. No. 5,798,016), Japanese Patent No. 3,261,044, JP-A 2001-164354, JP-A 2002-252209, JP-A 2002-222803, JP-A 2001-97791, JP-A 2002-293630 and Thermochimica ACTA, 87, 1985, 145.

Under the recent trend of semiconductor circuits being miniaturized, it becomes necessary to manage dusting from members and contamination by members to a higher extent. There is a demand for further enhancement of corrosion resistance. To meet such requirements, attempts have been made to construct members from high corrosion resistance materials as compared with conventional materials such as $Y_2O_3$, yttrium aluminate and $MgF_2$, or to form coats of these corrosion resistant materials on exposed surfaces of ceramic and metal substrates by deposition techniques like thermal spraying, CVD and PVD, as mentioned above. There is a need for coatings having higher corrosion resistance.

SUMMARY OF THE INVENTION

An object of the present invention is to provide a fluoride-containing coating having high corrosion resistance, and a coated member.

Regarding a Group IIIA element fluoride-containing coating having better corrosion resistance to corrosive halogen species, we have discovered that the coating has a crystalline phase, that the state of the crystalline phase largely affects the outer appearance of the coating to change its color, and that the hardness of the coating largely affects the corrosion resistance or weight loss thereof.

For example, the use of yttrium fluoride is known from the above-cited JP-A 2002-252209. Studying yttrium fluoride coatings, we found that a coating consisting solely of yttrium fluoride can change its color under the influence of corrosive halide gases. The only use of yttrium fluoride provides insufficient corrosion resistance, allowing the yttrium fluoride coating to be lost by corrosion.

This suggests that some chemical and/or physical changes occur upon exposure to corrosive gases.

Desirable in general are those members which are originally of a color giving a least noticeable color change and upon exposure to corrosive gases, undergo only a little change of the outer appearance, especially a little change of visually perceivable color. Also desirable are those members in which a yttrium fluoride coating is little lost by corrosion upon exposure to corrosive gases.

Making investigations with these borne in mind, we have discovered that the state of a crystalline phase in a coating governs the resistance of the coating to color change by corrosive halogen species and that the hardness of a coating largely governs the corrosion resistance or weight loss thereof.

We have found that when a Group IIIA element fluoride-containing coating contains a crystalline phase of Group IIIA element fluoride, which is of the orthorhombic system and belongs to space group Pnma, especially when the Group IIIA element contains at least one element selected from among Sm, Eu, Gd, Tb, Dy, Ho, Er, Y, Tm, Yb and Lu as a major component (at least 50 mol % of the Group IIIA elements), and which crystalline phase is a major phase, then the coating is significantly improved in corrosion resistance over the amorphous coating and experiences a minimum color change.

Examining the index of plane versus the diffraction intensity of a crystalline phase, we have found that for the crystalline phase which is of the orthorhombic system and belongs to space group Pnma, when the intensity ratio I(111)/I(020) of the diffraction intensity I(111) of plane index (111) to the diffraction intensity I(020) of plane index (020) is at least 0.3, the color change of the coating can be reduced to a color difference of 30 or less. We have further found that when the intensity ratio is at least 0.6, the color change can be reduced to a color difference of 10 or less. As a result, there is obtained a coated member which originally has a color giving a least noticeable color change and undergoes a little color change upon exposure to corrosive gases.

That is, there is obtained a Group IIIA element fluoride-containing coating whose color has a L* value of up to 90, $-2.0<a^*<2.0$, and $-10<b^*<10$, when expressed by the CIELAB colorimetric system, and which experiences a color change of up to 30 in color difference before and after exposure to corrosive gas.

We have also found that the Group IIIA element fluoride-containing coating wherein at least one element selected from among Sm, Eu, Gd, Tb, Dy, Ho, Er, Y, Tm, Yb and Lu is a major component (at least 50 mol % of the Group IIIA elements) is improved in corrosion resistance and significantly reduced or restrained in corrosion loss, if the coating has a micro-Vickers hardness Hv of at least 100.

The coating and the member having the coating according to the invention have been reduced into practice based on the above discoveries. The coating of the invention is a Group IIIA element fluoride-containing coating that (1) experiences only a little color change and (2) have good corrosion resistance and a minimized corrosion loss even when exposed to a corrosive halogen species such as corrosive halide gas or a plasma thereof. The Group IIIA element fluoride-containing coating contains a Group IIIA element fluoride crystalline phase and has been formed by depositing particles or molten droplets.

The present invention provides a Group IIIA element fluoride-containing coating and a coated member as defined below.

[1] A Group IIIA element fluoride-containing coating comprising a Group IIIA element fluoride phase which contains at least 50% of a crystalline phase of the orthorhombic system belonging to space group Pnma.

[2] The Group IIIA element fluoride-containing coating of [1] wherein the intensity ratio I(111)/I(020) of the diffraction intensity I(111) of plane index (111) to the diffraction intensity I(020) of plane index (020) of orthorhombic crystals in the Group IIIA element fluoride phase is at least 0.3.

[3] The Group IIIA element fluoride-containing coating of [1] or [2] wherein the Group IIIA element primarily comprises at least one element selected from the group consisting of Sm, Eu, Gd, Tb, Dy, Ho, Er, Y, Tm, Yb and Lu.

[4] The Group IIIA element fluoride-containing coating of any one of [1] to [3], comprising crystal grains having a size of at least 1 μm on surface observation.

[5] The Group IIIA element fluoride-containing coating of any one of [1] to [4], having a thickness of 1 μm to 500 μm.

[6] The Group IIIA element fluoride-containing coating of any one of [1] to [5] wherein the total content of Group IA elements and iron family elements other than incidental impurities of oxygen, nitrogen and carbon is up to 100 ppm.

[7] The Group IIIA element fluoride-containing coating of any one of [1] to [6] which has been prepared by depositing solid particles or molten droplets.

[8] The Group IIIA element fluoride-containing coating of [7] wherein the solid particles or molten droplets are comprised of the Group IIIA element fluoride.

[9] The Group IIIA element fluoride-containing coating of [7] or [8] wherein the solid particles or molten droplets have been prepared from a crystalline powder.

[10] The Group IIIA element fluoride-containing coating of any one of [1] to [9] which has been deposited under atmospheric pressure.

[11] The Group IIIA element fluoride-containing coating of any one of [1] to [10] which has been deposited on a substrate while heating the substrate.

[12] The Group IIIA element fluoride-containing coating of any one of [1] to [11] which has been deposited on a substrate while heating the substrate at a temperature of at least 80° C.

[13] A Group IIIA element fluoride-containing coating whose color has a L* value of up to 90, $-2.0<a^*<2.0$, and $-10<b^*<10$, when expressed by the CIELAB colorimetric system, and which experiences a color change of up to 30 in color difference before and after exposure to corrosive gas.

[14] The Group IIIA element fluoride-containing coating of [13] wherein the Group IIIA element primarily comprises at least one element selected from the group consisting of Sm, Eu, Gd, Tb, Dy, Ho, Er, Y, Tm, Yb and Lu.

[15] A Group IIIA element fluoride-containing coating having a micro-Vickers hardness Hv of at least 100.

[16] The Group IIIA element fluoride-containing coating of [15] wherein the Group IIIA element primarily comprises at least one element selected from the group consisting of Sm, Eu, Gd, Tb, Dy, Ho, Er, Y, Tm, Yb and Lu.

[17] A coated member comprising a substrate selected from the group consisting of oxides, nitrides, carbides, metals, carbon materials and resin materials, which is coated with the Group IIIA element fluoride-containing coating of any one of [1] to [16].

[18] The coated member of [17] wherein the substrate comprises an oxide.

[19] The coated member of [17] wherein the substrate comprises a nitride.

[20] The coated member of [17] wherein the substrate comprises a carbide.

[21] The coated member of [17] wherein the substrate comprises a metal material.

[22] The coated member of [17] wherein the substrate comprises a carbon material.

[23] The coated member of [17] wherein the substrate comprises a resin material.

Also contemplated herein are Group IIIA element fluoride-containing coatings having the features of [1] to [12] combined with the feature of [13] and/or [15] as well as coated members in which substrates are coated with these coatings.

DESCRIPTION OF THE PREFERRED EMBODIMENTS

Figure 1:
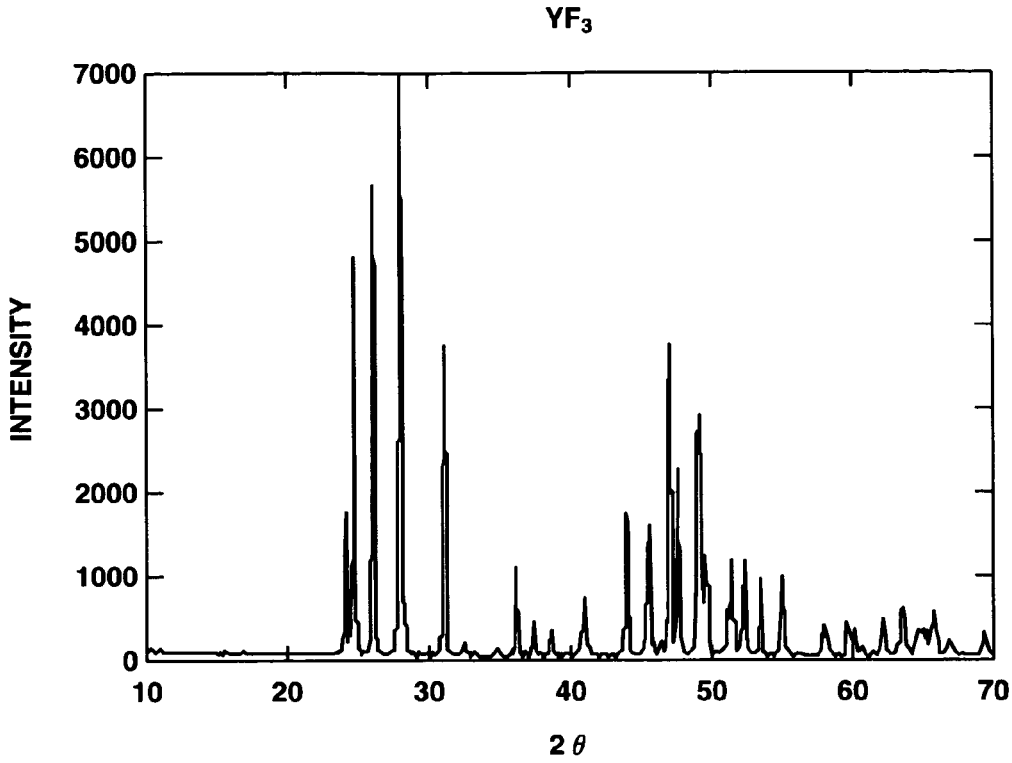
FIG. 1 is an x-ray diffraction diagram of a crystalline $YF_3$ powder used in Example.

The fluoride-containing coating of the present invention is a coating comprising at least a Group IIIA element and fluorine element. The coating contains a Group IIIA element fluoride phase, which contains at least 50% of a crystalline phase of the orthorhombic system belonging to space group Pnma.

The element of Group IIIA in the Periodic Table used herein is not particularly limited although it is preferably selected from among Sm, Eu, Gd, Tb, Dy, Ho, Er, Y, Tm, Yb and Lu.

Group IIIA element fluoride-containing coatings that contain plasma resistant materials such as Group IIA element fluorides, e.g., magnesium fluoride, calcium fluoride and barium fluoride, Group IIIA element oxides and complex oxides thereof, e.g., yttrium-aluminum complex oxide ($Y_3Al_5O_{12}$—$YAlO_3$—$Y_2Al_4O_9$) in addition to Group IIIA element fluorides, are contemplated as being encompassed within the invention because they can be used for certain purposes as long as the physical properties of Group IIIA element fluorides are within the scope of the invention. For example, a coating for which a peak of YOF is detected in addition to $YF_3$ on analysis by powder x-ray diffractometry, can be used and is encompassed within the invention as long as the $YF_3$ crystalline phase develops characteristics within the scope of the invention.

The fluoride-containing coating is preferably formed by thermal spraying processes, especially atmospheric thermal spraying processes.

The film-forming processes known in the art include physical deposition processes such as sputtering, evaporation and ion plating, chemical deposition processes such as plasma CVD and pyrolytic CVD, and wet coating processes such as sol-gel and slurry coating. It is preferred that the present coating be relatively thick as embodied by a thickness of at least 1 μm and highly crystalline. However, the physical and chemical deposition processes take a very long time until the desired thickness is reached and are thus uneconomical. Additionally, these processes need an atmosphere of reduced pressure. Since the size of members used in the semiconductor manufacturing apparatus is increased as a result of semiconductor wafers and glass substrates being recently enlarged in size, a high capacity vacuum unit is necessary to carry out deposition on such large sized members. The physical and chemical deposition processes are uneconomical in this sense too.

Also, the chemical deposition process and sol-gel process have the problems of a large size manufacturing apparatus and high temperature heating required to produce a highly crystalline coating. These problems limit the choice of a substrate to be coated and make it difficult to coat resinous and other materials which are less heat resistant than ceramic and metal materials.

JP-A 2002-293630 discloses to treat a Group IIIA element-containing ceramic material with a fluoride for modifying the surface into a Group IIIA element fluoride. The choice of substrate material is limited because the substrate must originally contain the Group IIIA element. It is difficult to form a surface layer to a thickness in excess of 1 μm.

With these problems taken into account, an application process capable of forming a highly crystalline coating having a thickness in the range of 1 μm to 1000 μm on a substrate at a relatively high rate, without imposing substantial limits on the material and size of the substrate is favorable in the practice of the invention. The favorable processes include spraying processes of melting or softening a material and depositing droplets thereof on a substrate, typically plasma spraying and high velocity flame spraying processes, a cold spraying process of impinging solid fine particles against a substrate at a high speed for deposition, and an aerosol deposition process.

As to the coating thickness, a minimum thickness of 1 μm is satisfactory. The coating thickness may vary from 1 μm to 1,000 μm. Since this range does not always inhibit corrosion, a thickness of about 10 to 500 μm is preferred for prolonging the life of a coated member.

Depending on the working atmosphere, the spraying is divided into atmospheric spraying and reduced pressure or vacuum spraying. Since the reduced pressure or vacuum spraying has to be performed in a reduced pressure or vacuum chamber, spatial or time limits are encountered in performing the process. To take advantage of the invention, the atmospheric spraying process which can be performed without a need for a special pressure vessel is preferred.

For producing a crystalline phase-containing coating according to the invention, it is preferred to use a crystalline phase material as a feed material. In the spraying process involving supplying the feed material in the form of a powder to a gas or plasma gas stream to deposit a coating, all the feed material is not introduced into the gas flame, and some non-melted or semi-melted particles are incorporated in the coating being deposited. In view of this phenomenon, in order to effectively produce a crystalline phase-containing coating according to the invention, it is desired that the material used in deposition have a crystalline phase.

The spraying process generally involves feeding a powder feed material into a plasma flame of an inert gas such as argon or a combustion gas of kerosene or propane to melt the particles partially or completely and depositing droplets on a substrate to form a coating. For the object of the invention to produce a coating containing a crystalline phase of Group IIIA element fluoride, it is desired that the feed material powder have an equivalent composition to the final coating. A powder containing a crystalline phase of Group IIIA element fluoride is more desirable, with anhydrous crystalline fluoride being most desirable.

The particle size and purity of the powder used may be determined as appropriate in accordance with the desired coating and the intended application. Particularly in the event a coated member is used within a processing chamber of a semiconductor manufacturing apparatus, the powder should be of high purity because it is requisite to minimize the introduction of impurity metal ions into semiconductor circuits.

For this reason or other, the coating of the invention and the feed material used therefor is desirably a Group IIIA element fluoride having a purity of at least 99.9%, which contains incidental impurities such as nitrogen, oxygen and carbon and in addition thereto, other impurities such as Group IA metal elements, iron family elements, alkaline earth elements and silicon, preferably in an amount of up to 100 ppm, more preferably up to 50 ppm. When a coating is deposited using such a high purity material, the impurity content in the coating is minimized. Such high purity products are essential in the semiconductor-related application. However, the high purity is not always required in fields or applications where only corrosion resistance to corrosive gases is required as in boiler exhaust pipe inner walls.

[Heat Treatment]

The fluoride-containing coating of the invention is characterized by its high crystallinity. The best deposition process is capable of forming a single phase coating having high crystallinity as deposited, but few such processes are generally available. The pyrolytic CVD process can form a coating having a relatively high crystallinity. However, the substrate must be heated to a temperature of 500 to 1,000° C., which restricts the material of the substrate, and the resulting coating is as thin as several microns. Other deposition processes require heat treatment at temperatures of several hundreds of centigrade or higher in order to enhance the crystalline phase, which restricts the material of the substrate as well. In particular, it is difficult to deposit coatings on substrates of resin materials, aluminum alloys and other materials which can be decomposed, softened or melted at several hundreds of centigrade. In the practice of the invention, coatings are preferably produced by depositing particles or molten droplets as described previously. The spraying process is capable of forming a coating having a relatively high crystallinity under controlled conditions because deposition is carried out by feeding particles with a size of several microns to several tens of microns into a plasma flame having a temperature of several thousands of centigrade to several ten thousands of centigrade for instantaneously melting or semi-melting the particles. However, quenching from such high temperature tends to create an amorphous phase or heterogeneous phase partially. In this regard, we have found that although a Group IIIA element fluoride coating will sometimes contain a second phase of the same material system as the primary phase, holding the coating at 200 to 500° C. converts the coating to a single phase coating consisting solely of the primary phase.

Therefore, in the practice of the invention, the coating may be held at a temperature in the range of 200 to 500° C. for a certain time, preferably at least 1 minute, more preferably at least 5 minutes, especially 10 to 600 minutes. The coating can be given such temperature hysteresis by setting adequate conditions during deposition (e.g., substrate temperature and working atmosphere) or by effecting heat treatment on the member after deposition (i.e., coated member).

For the setting of conditions during deposition, the substrate is preferably heated at a temperature of at least 80° C., more preferably at least 100° C., even more preferably at least 150° C. prior to deposition. The upper limit of temperature is preferably up to 600° C., though not critical. With such setting, the coating deposited on the substrate is moderately cooled. As a result, the coating is held in the range of 200 to 500° C. for at least 1 minute. Thus a crystalline phase-containing coating is readily available.

The heating means may be roasting of the substrate with a plasma flame during the spraying, use of an IR heater or the like, or use of a heated atmosphere during the spraying. The heating means is not limited to these as long as the substrate temperature is eventually raised.

The alternative way is heat treatment after deposition, that is, heat treatment of the coating together with the underlying substrate. The upper limit of temperature is determined in accordance with the melting point or decomposition temperature of the coating material, the softening or deflection temperature of the substrate or the like, although a temperature within the range of 200 to 500° C. is desirable, also from the economical standpoint. With respect to the atmosphere for heat treatment, no limit is imposed on the choice of atmosphere when the temperature is not higher than 400° C. At temperatures above 400° C. with concerns on the reaction of fluoride with oxygen, a vacuum, reduced pressure or inert gas atmosphere is preferred in the sense of suppressing any chemical change of the material.

The fluoride-containing coating is deposited and formed on any suitable substrate. No particular limits are imposed on the type of substrate. Deposition may be made on substrates of any materials such as oxides, nitrides, carbides, metal materials, carbon materials and resin materials. The oxide substrates include shaped bodies composed mainly of quartz, $Al_2O_3$, MgO, $Y_2O_3$ and complex oxides thereof. The nitride substrates include shaped bodies composed mainly of silicon nitride, aluminum nitride, boron nitride and the like. The carbide substrates include shaped bodies composed mainly of silicon carbide, boron carbide and the like. Suitable metal materials include metal materials composed mainly of iron, aluminum, magnesium, copper, silicon or nickel and alloys thereof such as stainless alloys, aluminum alloys, anodized aluminum alloys, magnesium alloys, copper alloys, and single crystal silicon. Suitable carbon materials include carbon fibers and sintered carbon bodies. Suitable resin materials include substrates made of or coated with fluoro-resins such as polytetrafluoroethylene, and heat resistant resins such as polyimides and polyamides.

Combinations of any two or more of the foregoing substrate materials are acceptable, for example, a metal material coated with a ceramic coating, an aluminum alloy which has been anodized, and such a material which has been subjected to surface treatment such as plating.

Particularly when electroconductivity is necessary, aluminum alloys are used. When electrical insulation is necessary, ceramic materials such as quartz, alumina, aluminum nitride, silicon nitride, silicon carbide, and boron nitride or resin materials are used as the substrate. Once coatings of the invention are formed thereon, coated members satisfying the required function and corrosion resistance are obtainable.

Typical members to be exposed to a plasma in the semiconductor manufacturing process are upper and lower electrodes located in an etching apparatus or the like. A high-frequency power is applied between the electrodes to induce an electric discharge in the atmosphere gas to create a plasma with which an object is etched. The upper and lower electrodes must be electroconductive for enabling application of a high-frequency power and are thus made of aluminum alloys or silicon, or alumina or aluminum nitride having metal conductor built therein. These members are preferably provided with Group IIIA element fluoride-containing coatings for the purpose of imparting corrosion resistance thereto.

The members (e.g., domes and barrels) of which the processing vessels are constructed are often made of aluminum alloys, stainless alloys, ceramics or quartz. The present coating may be provided on the surface of these members to be exposed to a plasma. When a plasma-forming gas is exhausted from a chamber for establishing a high vacuum in the chamber, an exhaust pipe and a turbo-molecular pump are used. The present coating may be provided on members within the exhaust pipe or internal blades of the turbo-molecular pump.

The fluoride-containing coating of the invention is characterized by comprising a crystalline phase which is of Group IIIA element fluoride. This feature ensures plasma resistance. When the proportion of a crystalline phase of the orthorhombic system belonging to space group Pnma is at least 50%, preferably at least 70%, more preferably at least 90%, the coating is prevented from discoloration by exposure to a corrosive halogen plasma.

In a preferred embodiment, the fluoride-containing coating possesses a hardness, surface state and color characteristics as described below.

[Hardness]

For use in an atmosphere where a corrosive halogen species is present, especially in a dry etching or similar process where kinetic energy whose direction is controlled by means of an electric field or magnetic field is imparted to a plasma-forming halogen species for selectively etching an object, the fluoride-containing coating must also have physical corrosion resistance to the corrosive halogen species having kinetic energy. Although a yttrium fluoride coating was believed to be free from weight loss due to chemical corrosion resistance, it is presumed that in fact, a weight loss occurs, that is, a physical weight loss occurs through the above-described mechanism. To improve corrosion resistance in terms of physical weight loss, the coating must substantially have a hardness Hv of at least 100 as measured by the micro-Vickers method. With a hardness Hv of less than 100 as measured by the micro-Vickers method, the effect of reducing or suppressing the weight loss as one corrosion resistance factor is not obtainable. The hardness Hv according to the micro-Vickers method is preferably at least 150, more preferably at least 200. Its upper limit is up to 2000, especially up to 1500, though not critical.

[Surface Observation]

The surface of a Group IIIA element fluoride-containing coating according to the invention was observed under an electron microscope with a magnifying power of 1000×. The size of crystal grains was measured from a secondary electron image. It is preferred that the coating be constructed of grains having a size of at least 1 μm, more preferably at least 5 μm, even more preferably at least 10 μm.

[Color]

One feature of the invention is to restrain discoloration of the surface of a coating upon exposure to a plasma. Color is expressed by the L*a*b* colorimetric system according to JIS Z8729. The L* value represents lightness, a positive value of a* represents red, a negative value of a* represents green, a positive value of b* represents yellow, and a negative value of b* represents blue. In order to suppress the color change of a Group IIIA element fluoride-containing coating upon exposure to corrosive halogen gas to a less noticeable level, the state of a Group IIIA element fluoride crystalline phase in the coating may be controlled. More particularly, in the embodiment wherein the Group IIIA element in the coating comprises primarily (at least 50 mol % based on the Group IIIA elements) at least one element selected from the group consisting of Sm, Eu, Gd, Tb, Dy, Ho, Er, Y, Tm, Yb and Lu and further wherein the crystalline phase of Group IIIA element fluoride is of the orthorhombic system, and the crystalline phase of the orthorhombic system constitutes at least 50%, more preferably at least 70%, even more preferably at least 90% of the entire Group IIIA element fluoride crystalline phase, if the coating has a color given by a L* value of up to 90, $-2.0<a^*<2.0$, and $-10<b^*<10$, more preferably a L* value of up to 80, $-1.0<a^*<1.0$, and $-5<b^*<5$, most preferably a L* value of up to 75, when expressed by the L*a*b* colorimetric system, then the color change is suppressed to a color difference of 30 or less.

When the proportion of the orthorhombic system among the crystalline phase of Group IIIA element fluoride in the coating is at least 90%, the color change is further restrained, that is, a coating with a color difference of 10 or less is obtained.

Further, when the intensity ratio I(111)/I(020) of the diffraction intensity I(111) of plane index (111) to the diffraction intensity I(020) of plane index (020) of orthorhombic crystals is at least 0.3, the color change of the coating is suppressed to a color difference of 30 or less. When the intensity ratio I(111)/I(020) between these plane indexes is at least 0.6, the color difference is suppressed to 10 or less.

According to the invention, in a Group IIIA element fluoride-containing coating for covering the surface of a member to be exposed to a corrosive halogen species-containing atmosphere for imparting corrosion resistance thereto, the color change of the coating by corrosion is restrained by controlling the state of a crystalline phase in the coating. The presence of a crystalline phase in the Group IIIA element fluoride-containing coating is effective for improving the corrosion resistance. When the crystalline phase is of the orthorhombic system and the coating consists essentially of a single phase, the color change of the coating is restrained.

When the coating has a hardness Hv of at least 100 as measured by the micro-Vickers method, the weight loss of the coating is reduced or restrained.

EXAMPLE

Examples are given below together with Comparative Examples for further illustrating the invention although the invention is not limited thereto.

First, test methods are described below.

Crystalline Phase Test

The sample used for the evaluation of a crystalline phase was a sprayed coating on a plate-shaped substrate. Diffraction analysis on the surface of the coating was performed by a powder x-ray diffractometer RAD-C (Rigaku Corp.) using a radiation source of CuKα over the range of 2θ from 10 degrees to 70 degrees. From the diffraction pattern, the crystalline phase was identified by the qualitative analysis program. The sample for analysis may also be obtained by removing the sprayed coating from the substrate, grinding the coating in an agate mortar or the like, and packing the powder in a sample holder.

The index of plane of each crystalline phase and the peak intensity thereof are obtained from the results of qualitative analysis of the diffraction pattern, and computed from the diffraction intensities of the intensity ratio between indexes of plane. If a crystalline phase is present, a peak is observable in the above-described range of measurement angle.

The proportion of crystalline phases is computed from the ratio of the maximum intensity of a diffraction peak identified to assign to the orthorhombic crystals in the preceding qualitative analysis to the maximum peak intensity attributable to another Group IIIA fluoride phase. That is, the content of orthorhombic crystals is computed by the following equation:

$$\text{orthorhombic content}=It/(It+Io)$$

wherein It is the maximum peak intensity of orthorhombic crystals and Io is the maximum peak intensity attributable to other Group IIIA fluoride phase.

Based on this equation, the state that a Group IIIA element fluoride crystal phase of the orthorhombic system is a major phase means that the orthorhombic content=It/(It+Io) is at least 50%.

Hardness Test

The micro-Vickers hardness was measured by a digital micro-hardness tester (Matsuzawa Co., Ltd.)

The surface (coating surface) of a sample to be tested was polished and a load of 300 g was applied to the probe to indent the surface. The size of indentation was measured under a microscope, from which a micro-Vickers hardness Hv was computed.

Plasma Resistance Test

For the evaluation of corrosion resistance to corrosive halogen species, a dry etching process of positively inducing corrosion was employed. The dry etching process is by creating an active plasma from a gaseous halide (e.g., $CF_4$, $NF_3$, $Cl_2$) in an electric field or the like and causing an object to be corroded therewith. Since the active halogen species has a high activity, the process is adequate for the evaluation of corrosion resistance.

In the halogen plasma resistance test, a plasma etching apparatus was used. The sample to be tested is a sample of 10 mm square, which was rested on a silicon wafer and set in place within the chamber. By feeding a gas mixture of $CF_4$+20% $O_2$ to the chamber and applying a power of 1000 W at a frequency of 13.56 MHz, a plasma environment is created where plasma treatment was carried out for 10 hours. Plasma resistance was evaluated by measuring the weight of the treated sample and computing an etching rate from a weight change before and after the treatment. A sintered alumina body having a sintered density of 99% as a reference showed a weight loss of 2.5 mg after the same test. If the weight loss of a sample is not more than one half of the reference, i.e., not more than 1.25 mg, the sample is regarded as having plasma resistance.

Chromaticity and Color Difference Measurement

The color of a coating was measured by a color meter CR-210 (Minolta Co., Ltd.). That is, the chromaticity (CIELAB colorimetric system) of a sample was measured according to JIS Z8729, obtaining values of L*, a* and b*. Using the L*, a* and b* values of the sample before and after the plasma resistance test, a color difference ΔE*ab was computed according to the following equation.

$$\Delta E^*ab=\sqrt{(L^*i-L^*t)^2+(a^*i-a^*t)^2+(b^*i-b^*t)^2}$$

chromaticity before test: L*i, a*i, b*i
chromaticity after test: L*t, a*t, b*t

Example 1

There was furnished an aluminum alloy substrate of 20 mm square. The surface was degreased with acetone and roughened with abrasives of corundum. By operating an atmospheric plasma spraying apparatus at an output of 40 kW and a spray distance of 100 mm while feeding argon gas as a plasma-forming gas, crystalline $YF_3$ powder was sprayed at a rate of 30 μm/pass until a thickness of 300 μm was reached. Prior to the spraying, the substrate was roasted with the plasma gas and thereby heated to 250° C. whereupon deposition was started. FIG. 1 is an x-ray diffraction diagram of the crystalline $YF_3$ powder used herein. It is evident from FIG. 1 that the feed material is highly crystalline $YF_3$ of single phase.

Figure 2:
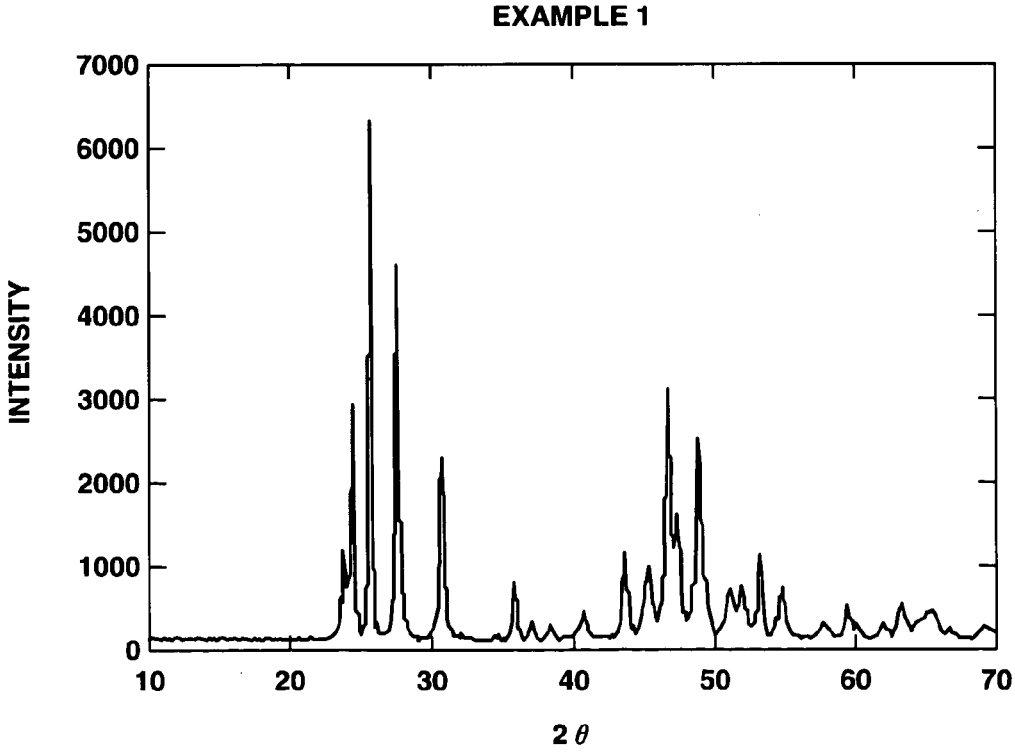
FIG. 2 is an x-ray diffraction diagram of the $YF_3$ coating of Example 1.

The surface of the coating was analyzed by an x-ray diffractometer, with the results shown in FIG. 2.

As a result of qualitative analysis, the coating was identified to be a single phase coating of JCPDS Card No. 32-1431, the profile having the crystalline structure of $YF_3$ belonging to orthorhombic space group Pnma.

Figure 5:
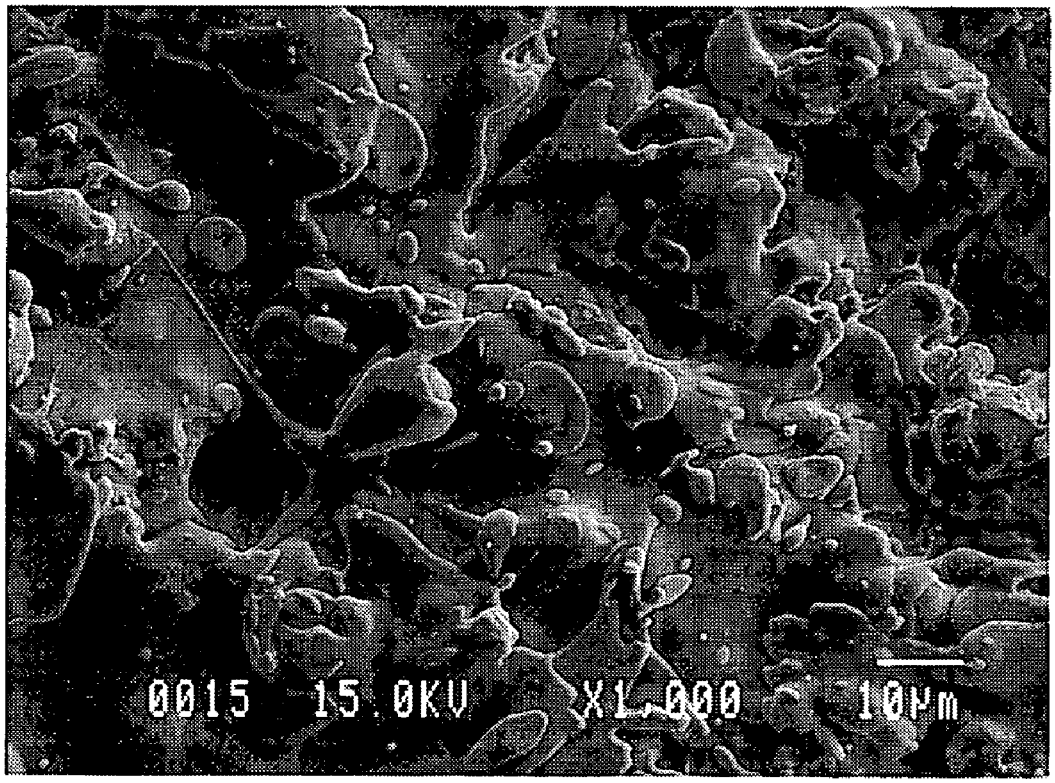
FIG. 5 is a photomicrograph of the surface of the coating obtained in Example 1.

The surface of the coating was observed under an electron microscope, finding grains having a size of 10 μm. FIG. 5 is a photomicrograph of the coating surface observed.

Next, chromaticity was measured by the above-described procedure.

For the plasma resistance test, a sample was cut to dimensions of 10 mm square. The plasma resistance test was carried out on this sample to examine the resistance to fluoride plasma and the color change of the coating. After the plasma resistance test, the sample was taken out, and the weight thereof was measured by means of a precision balance. Then a weight loss by corrosion of 1.05 mg was computed, indicating sufficient corrosion resistance. The surface of the sample was measured for chromaticity before and after the plasma resistance test. A color difference ΔE*ab was computed according to the aforementioned equation. The results are shown in Table 2.

Example 2

Figure 3:
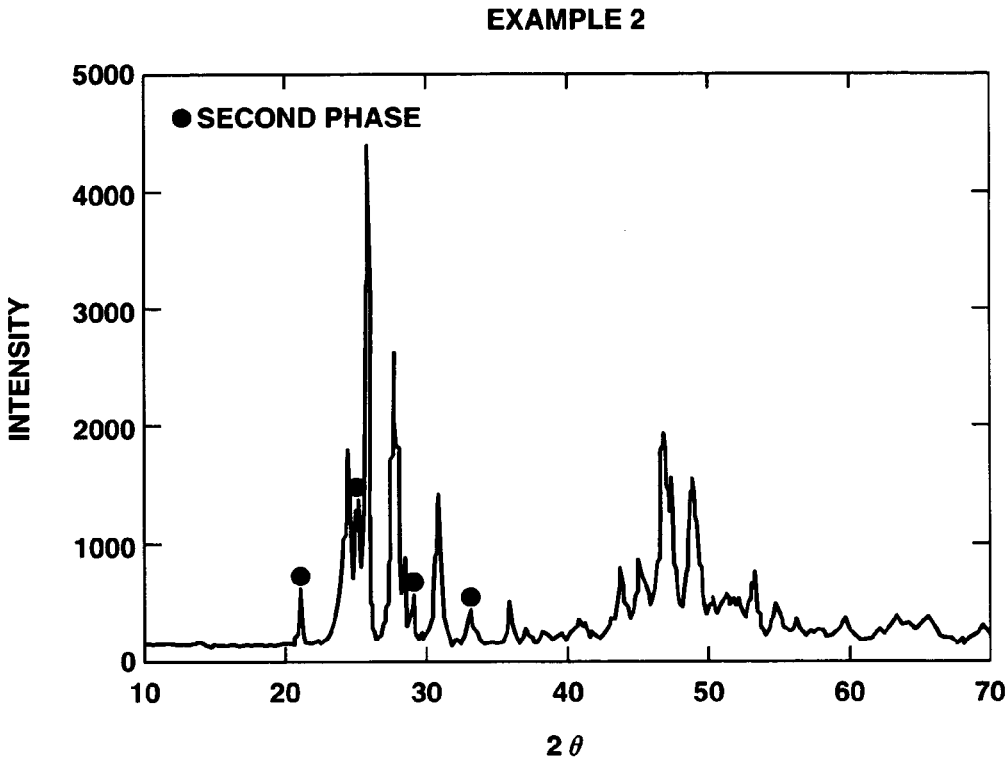
FIG. 3 is an x-ray diffraction diagram of the $YF_3$ coating of Example 2.

A coating was deposited under similar conditions to Example 1. Prior to the spraying, the substrate was heated to 80° C. The results of x-ray diffractometry on the coating surface are shown in FIG. 3. The coating contained orthorhombic $YF_3$ of JCPDS Card No. 32-1431, the diffraction profile of $YF_3$, and a second phase having peaks at angles 2θ of approximately 21.1, 25.2 and 29.3 degrees. The orthorhombic crystal content of this coating was 72% as computed by the above-described procedure.

The surface of the coating was observed under an electron microscope, finding a grain size of 5 μm.

On this coating, chromaticity measurement and the fluoride plasma resistance test were carried out as in Example 1.

Example 3

As in Example 2, $YF_3$ was deposited on an aluminum substrate. The resulting coating was heat treated in an air atmosphere at 300° C. for one hour. On this sample, identification of crystalline phase by x-ray diffractometry, quantification, chromaticity measurement and the fluoride plasma resistance test were carried out as in Example 1.

Example 4

Like Example 1, in a reduced pressure plasma spraying apparatus using a mixture of argon and helium gases as a plasma-forming gas, crystalline $YF_3$ powder was sprayed onto an aluminum alloy substrate to form a coating of 300 μm thick. In the apparatus, the substrate was held in vacuum at 300° C. for 10 minutes, following which the apparatus was recovered to atmospheric pressure and the sample was taken out. On this sample, identification of crystalline phase by x-ray diffractometry, quantification, chromaticity measurement and the fluoride plasma resistance test were carried out as in Example 1.

Examples 5-7

Under similar conditions to Example 1, $TbF_3$ (Example 5), $DyF_3$ (Example 6) and (Yb—Lu—Tm)$F_3$ (Example 7) were deposited. These samples were subjected to the evaluation of crystalline phase by x-ray diffractometry, the plasma resistance test, hardness measurement, color evaluation and the measurement of grain size on the coating surface under an electron microscope.

All the samples had a crystalline phase belonging to the orthorhombic system and exhibited satisfactory plasma resistance. The crystal grains had a size of 1 μm.

Comparative Example 1

An aluminum alloy substrate of 20 mm square was furnished and a yttrium fluoride coating was formed thereon by a vacuum evaporation process. The coating was observed under an electron microscope to find a thickness of 1 μm.

An attempt to identify a fluoride phase on the surface was made by x-ray diffractometry, with no crystalline phase of $YF_3$ observed.

The sample was subjected to the plasma resistance test. The coating was entirely corroded under the test conditions, indicating inferior corrosion resistance. A surface observation under an electron microscope revealed no crystal grains.

Comparative Example 2

Figure 4:
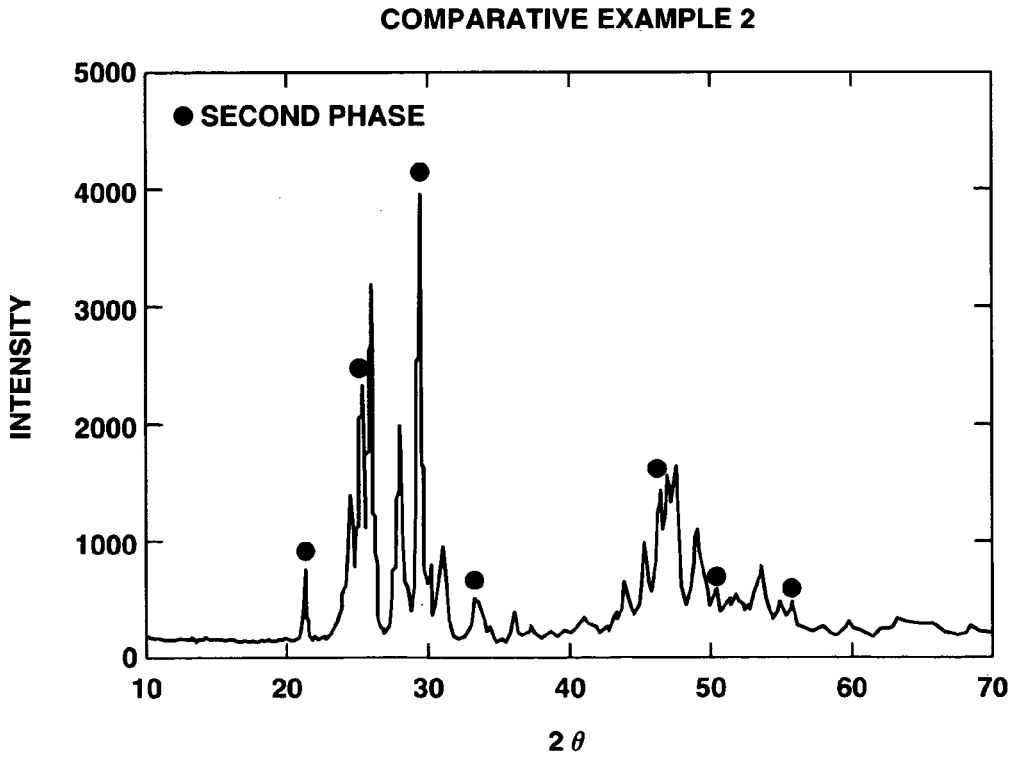
FIG. 4 is an x-ray diffraction diagram of the $YF_3$ coating of Comparative Example 2.

A coating was deposited as in Example 1. Deposition was carried out without heating the substrate prior to the spraying. The results of x-ray diffractometry on this sample are shown in FIG. 4. The coating was crystalline and contained a crystalline phase of the orthorhombic system and a second phase having peaks at angles 2θ of approximately 21.1, 25.2 and 29.3 degrees. Since the maximum intensity of orthorhombic grains was the peak at 2θ=25.8 degrees and the maximum intensity of the second phase was the peak at 2θ=29.3 degrees, the orthorhombic crystal content of this coating was 44% as computed by the above-described procedure. On this coating, chromaticity measurement and the fluoride plasma resistance test were carried out as in Example 1.

The results of qualitative analysis by x-ray diffractometry and the results of the plasma resistance test are also shown in Table 1.

Comparative Example 3

There was furnished an aluminum alloy substrate of 20 mm square. The surface was degreased with acetone and roughened with abrasives of corundum. By operating an atmospheric plasma spraying apparatus at an output of 40 kW and a spray distance of 150 mm while feeding argon gas as a plasma-forming gas, crystalline $YF_3$ powder was sprayed at a rate of 30 μm/pass until a thickness of 300 μm was reached.

This sample was subjected to x-ray diffractometry, the plasma resistance test, chromaticity measurement and hardness measurement.

In the plasma resistance test, the sample showed a weight loss of 2.1 mg, indicating fair plasma resistance.

TABLE 1

| Sample | Material | Conditions | Substrate heating | Atmosphere | Orthorhombic content | Plasma resistance |
|---|---|---|---|---|---|---|
| Example | | | | | | |
| 1 | $YF_3$ | atmospheric spraying, Ar | heated 250° C. during spraying | vacuum | 100% | good |

TABLE 1-continued

| Sample | Material | Conditions | Substrate heating | Atmosphere | Orthorhombic content | Plasma resistance |
|---|---|---|---|---|---|---|
| 2 | $YF_3$ | atmospheric spraying, Ar | heated 80° C. prior to spraying | air | 72% | good |
| 3 | $YF_3$ | atmospheric spraying, Ar + $H_2$ | reheated 300° C. after spraying | nitrogen | 100% | good |
| 4 | $YF_3$ | vacuum spraying | held 250° C./10 min after spraying | | 100% | good |
| 5 | $TbF_3$ | atmospheric spraying, Ar | heated 250° C. during spraying | air | 100% | good |
| 6 | $DyF_3$ | atmospheric spraying, Ar | heated 250° C. during spraying | air | 100% | good |
| 7 | (YbLuTm) $F_3$ | atmospheric spraying, Ar | heated 250° C. during spraying | air | 90% | good |
| Comparative Example | | | | | | |
| 1 | $YF_3$ | PVD | — | — | amorphous | inferior |
| 2 | $YF_3$ | atmospheric spraying, Ar + $H_2$ | not heated | — | 44% | good |
| 4 | $Al_2O_3$ | ceramics | — | — | — | fair |

These results indicate that coatings having a crystalline phase exhibit better corrosion resistance than amorphous coatings. The results of Examples 1 to 3 indicate that when a coating is held at a temperature of at least 200° C. its crystalline phase converts to one consisting essentially of orthorhombic crystals.

Color Change

Table 2 shows the color and color change ΔE*ab on the surface of samples before and after the fluoride plasma resistance test. The color was measured according to JIS Z8729. The color difference ΔE*ab was computed by the above-described procedure.

For the coatings having a crystalline phase belonging to the orthorhombic system, when the intensity ratio I(111)/I(020) of the diffraction intensity I(111) of plane index (111) to the diffraction intensity I(020) of plane index (020) is substantially at least 0.3, the color difference ΔE*ab is 30 or less. When the intensity ratio I(111)/I(020) is at least 0.6, the color difference ΔE*ab is 10 or less.

Hardness

The hardnesses of the coatings of Examples 1 to 7 as measured by a micro-Vickers hardness meter are shown in Table 3 together with the results of the plasma resistance test.

TABLE 2

| Sample | Orthorhombic content | I(111)/ I(020) | Initial L* | Initial a* | Initial b* | After test L* | After test a* | After test b* | ΔE*ab |
|---|---|---|---|---|---|---|---|---|---|
| Example 1 | 100% | 0.67 | 72.79 | −0.12 | 2.47 | 64.58 | 0.94 | 6.83 | 9.36 |
| Example 2 | 72% | 0.38 | 72.14 | 0.30 | 2.00 | 45.89 | 0.33 | 2.84 | 26.26 |
| Example 3 | 100% | 0.82 | 84.11 | −0.23 | 2.27 | 80.10 | −0.40 | 3.11 | 4.10 |
| Example 4 | 100% | 0.85 | 33.60 | 0.68 | 3.34 | 36.13 | 0.65 | 2.81 | 2.59 |
| Example 5 | 100% | 0.62 | 77.40 | −0.09 | 2.71 | 67.92 | 0.37 | 0.70 | 9.70 |
| Example 6 | 100% | 0.79 | 73.34 | −0.55 | 2.67 | 67.23 | 0.19 | 1.44 | 6.28 |
| Example 7 | 90% | 0.81 | 64.38 | −0.86 | 2.31 | 60.55 | 0.11 | 0.55 | 4.33 |
| Comparative Example 2 | 44% | 0.28 | 96.00 | 0.36 | 2.64 | 51.18 | 0.34 | 0.67 | 44.86 |

As is evident from these results, the coatings within the scope of the invention have an L* value of up to 90, $-2.0<a^*<2.0$ and $-10<b^*<10$, and experience a color difference ΔE*ab of 30 or less after the plasma exposure.

The coatings in which the crystalline phase contains at least 90% of orthorhombic grains exhibit an initial color having an L* value of up to 90, $-2.0<a^*<2.0$ and $-10<b^*<10$, and experience a color change, i.e., color difference ΔE*ab of up to 10 after the plasma exposure, with the color change becoming less noticeable.

TABLE 3

| Sample | Hv | Plasma resistance test: Weight loss (mg) | Plasma resistance test: Plasma resistance |
|---|---|---|---|
| Example 1 | 162 | 1.05 | Good |
| Example 2 | 154 | 1.12 | Good |
| Example 3 | 340 | 0.62 | Good |
| Example 4 | 272 | 0.87 | Good |
| Example 5 | 247 | 0.93 | Good |
| Example 6 | 232 | 0.81 | Good |

TABLE 3-continued

| Sample | Hv | Plasma resistance test | |
|---|---|---|---|
| | | Weight loss (mg) | Plasma resistance |
| Example 7 | 201 | 1.02 | Good |
| Comparative Example 3 | 71 | 2.1 | Fair |

As is evident from the above results, coatings exhibit satisfactory corrosion resistance when they substantially have a micro-Vickers hardness Hv of at least 100.

Impurity Analysis

The content of metal impurities in the coating of Example 1 was quantitatively analyzed by glow discharge mass spectrometry (GDMS), with the results shown in Table 4.

TABLE 4

| Element | Content (ppm) |
|---|---|
| Fe | 3 |
| Mg | 2 |
| Cu | <1 |
| Na | 6 |
| Ni | 2 |
| Ca | <1 |
| Cr | <1 |
| K | 2 |
| Al | 5 |
| W | <1 |
| Total | <23 |

The total content of impurities in the form of Group IA and iron family metal elements other than oxygen, nitrogen and carbon was less than 23 ppm. It is understood that the permissible total impurity content is up to 100 ppm in a substantial sense.

Examples 8-21

$YF_3$ coatings were deposited to a thickness of 300 μm as in Example 1 except that substrates of 20 mm square and 2 mm thick were made of various materials as shown in Table 5. The results of x-ray diffractometry (orthorhombic content), intensity ratio I(111)/I(020) and the results of the plasma resistance test are also shown in Table 5.

TABLE 5

| Sample | Substrate | Orthorhombic content | Plasma resistance | I(111)/I(020) |
|---|---|---|---|---|
| Example 8 | sintered alumina | 100% | good | 0.81 |
| Example 9 | quartz | 100% | good | 0.58 |
| Example 10 | sintered $Y_2O_3$ | 100% | good | 0.91 |
| Example 11 | sintered yttrium aluminum complex oxide | 100% | good | 1.10 |
| Example 12 | sintered cordierite | 100% | good | 0.82 |
| Example 13 | sintered aluminum nitride | 100% | good | 0.50 |
| Example 14 | sintered silicon nitride | 100% | good | 0.78 |
| Example 15 | sintered silicon carbide | 100% | good | 0.77 |
| Example 16 | pyrolytic boron nitride compact | 100% | good | 0.65 |
| Example 17 | anodized aluminum | 100% | good | 0.62 |
| Example 18 | stainless steel SUS316 | 100% | good | 0.65 |
| Example 19 | silicon | 100% | good | 0.70 |

TABLE 5-continued

| Sample | Substrate | Orthorhombic content | Plasma resistance | I(111)/I(020) |
|---|---|---|---|---|
| Example 20 | graphite | 100% | good | 0.72 |
| Example 21 | molded polyimide | 92% | good | 1.20 |

It is evident from the above results that the coatings formed on substrates of different materials have a crystalline phase of $YF_3$ belonging to the orthorhombic system and satisfactory plasma resistance.

Japanese Patent Application No. 2002-368426 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A fluoride-containing coating containing an element selected from the group consisting of Sm, Eu, Gd, Tb, Dy, Ho, Er, Y, Tm, Yb and Lu and comprising a fluoride phase of the element which contains at least 50% of a crystalline phase of the orthorhombic system belonging to space group Pnma as a primary crystalline phase on the basis of the entire crystalline phase, the fluoride-containing coating being formed by a thermal spraying process comprising supplying a feed material in form of powder to gas or plasma gas stream, melting or softening the material and depositing droplets thereof on a substrate, and a heat treatment by holding the coating at a temperature in the range of 200 to 500° C. for at least 1 minute during or after the thermal spraying.

2. The fluoride-containing coating of claim 1 wherein the intensity ratio 1(111)/I(020) of the diffraction intensity I(111) of plane index (111) to the diffraction intensity I(020) of plane index (020) of orthorhombic crystals in the fluoride phase is at least 0.3.

3. The fluoride-containing coating of claim 1, comprising crystal grains having a size of at least 1 μm on surface observation.

4. The fluoride-containing coating of claim 1, having a thickness of 1 μm to 500 μm.

5. The fluoride-containing coating of claim 1 wherein the total content of Group IA elements and iron family elements other than incidental impurities of oxygen, nitrogen and carbon is up to 100 ppm.

6. The fluoride-containing coating of claim 1 which has been prepared by depositing molten droplets.

7. The fluoride-containing coating of claim 6 wherein the molten droplets comprise fluoride containing an element selected from the group consisting of Sm, Eu, Gd, Tb, Dy, Ho, Er, Y, Tm, Yb and Lu.

8. The fluoride-containing coating of claim 6 wherein the molten droplets have been prepared from a crystalline powder.

9. The fluoride-containing coating of claim 1 which has been deposited under atmospheric pressure.

10. The fluoride-containing coating of claim 1 which has been deposited on a substrate while heating the substrate.

11. The fluoride-containing coating of claim 1 whose color has a L* value of up to 90, $-2.0<a^*<2.0$, and $-10<b^*<10$, when expressed by the CIELAB colorimetric system, and which experiences a color change of up to 30 in color difference before and after exposure to corrosive gas.

12. The fluoride-containing coating of claim 1 which has a micro-Vickers hardness Hv of at least 100.

13. A coated member comprising a substrate selected from the group consisting of oxides, nitrides, carbides, metals, carbon materials and resin materials, which is coated with the fluoride-containing coating of any one of claims 1, 11 or 12.

14. The coated member of claim 13 wherein the substrate comprises an oxide.

15. The coated member of claim 13 wherein the substrate comprises a nitride.

16. The coated member of claim 13 wherein the substrate comprises a carbide.

17. The coated member of claim 13 wherein the substrate comprises a metal material.

18. The coated member of claim 13 wherein the substrate comprises a carbon material.

19. The coated member of claim 13 wherein the substrate comprises a resin material.

20. The fluoride-containing coating of claim 1, wherein the fluoride phase consists of a single phase of the primary phase.

* * * * *